US008807222B2

(12) United States Patent
Jeronimo

(10) Patent No.: US 8,807,222 B2
(45) Date of Patent: Aug. 19, 2014

(54) PROCESS FOR REDUCING THE PRESSURE FOR INJECTING A POLYMER SOLUTION INTO AN OIL WELL WITHOUT SHEAR ON SAID SOLUTION

(75) Inventor: Philippe Jeronimo, Montrond les Bains (FR)

(73) Assignee: S.P.C.M. SA, Andrezieux-Boutheon (FR)

( * ) Notice: Subject to any disclaimer, the term of this patent is extended or adjusted under 35 U.S.C. 154(b) by 241 days.

(21) Appl. No.: 13/044,052

(22) Filed: Mar. 9, 2011

(65) Prior Publication Data

US 2011/0226480 A1 Sep. 22, 2011

(30) Foreign Application Priority Data

Mar. 16, 2010 (FR) ..... 10 51847

(51) Int. Cl.
*E21B 43/26* (2006.01)
*E21B 43/16* (2006.01)
*E21B 21/06* (2006.01)

(52) U.S. Cl.
CPC ..... *E21B 43/16* (2013.01); *E21B 21/062* (2013.01); *E21B 43/26* (2013.01)
USPC ..... 166/308.3; 166/275; 166/305.1; 166/90.1; 417/214

(58) Field of Classification Search
USPC ..... 166/308.3, 270.1, 275, 305.1, 90.1; 417/214, 216, 426; 137/565.01, 545; 210/427
See application file for complete search history.

(56) References Cited

U.S. PATENT DOCUMENTS

| | | | | |
|---|---|---|---|---|
| 3,985,468 | A * | 10/1976 | Lewis | 417/214 |
| 4,204,574 | A | 5/1980 | Stalder | |
| 4,510,397 | A | 4/1985 | Schroeder, Jr. | |
| 2007/0277974 | A1 * | 12/2007 | DiFoggio | 166/249 |
| 2008/0104955 | A1 * | 5/2008 | Khalil | 60/465 |
| 2008/0176770 | A1 * | 7/2008 | Sanders et al. | 507/213 |
| 2009/0196769 | A1 * | 8/2009 | Davis, Sr. | 417/333 |
| 2009/0242201 | A1 | 10/2009 | Van Beurden et al. | |

FOREIGN PATENT DOCUMENTS

| | | | |
|---|---|---|---|
| CA | 1209466 | A1 | 8/1986 |
| WO | 2008/081048 | A2 | 7/2008 |

OTHER PUBLICATIONS

French Search Report for FR 1051847 dated Nov. 5, 2010.
Vetter, Gerhard et al., "Understand Progressing Cavity Pumps Characteristics and Avoid Abrasive Wear", Proceedings of the Twelfth International Pump Users Symposium.

* cited by examiner

*Primary Examiner* — Cathleen Hutchins
*Assistant Examiner* — Taras P Bemko
(74) *Attorney, Agent, or Firm* — Heslin Rothenberg Farley & Mesiti P.C.

(57) ABSTRACT

A process is provided for reducing the pressure for injecting a solution of water-soluble polymer from a given injection pump into various oil wells in a given field as a function of the fracturation pressure for each well. Between the injection pump and each well, a respective main volumetric pump is placed. The fracturation pressure of each well is detected with a respective manometer, and the flow rate of each volumetric pump is controlled, using a brake, as a function of detected fracturation pressure of the respective well.

11 Claims, 2 Drawing Sheets

PROCESS FOR REDUCING THE PRESSURE FOR INJECTING A POLYMER SOLUTION INTO AN OIL WELL WITHOUT SHEAR ON SAID SOLUTION

CROSS REFERENCE TO RELATED APPLICATIONS

This application claims priority of French Patent application number 1051847 filed on Mar. 16, 2010, the entire contents of which is hereby incorporated by reference herein.

BACKGROUND ART

The object of the invention is a process for reducing the pressure for injecting a solution of water-soluble polymer into oil wells in a given field as a function of their fracturing pressure and to do this without shear in said solution.

In many oil industry operations, fluid pressure has to be reduced in a differentiated way between several injection lines.

This operation is done with chokes that are in fact variable-passage valves, regulated or not, which reduce the pressure, limiting downstream flow rates and pressures. This is particularly important for water flooding operations, where a given line serves various injection wells. Since each well has a different fracturing pressure, starting from a given pump the pressure has to be reduced and controlled precisely for each well. This equipment has become more and more sophisticated, especially for offshore operations from platforms or FPSO. They are operated remotely, electrically or pneumatically, and opened progressively as a function of the angle of rotation.

Additionally, enhanced oil recovery has been developed since the first oil crisis in 1973, especially in the USA, to increase recovery of the oil in place. The most effective method for low-temperature fields (<120° C.) is injecting a viscous solution that homogenizes the mobility of the water and oil and delivers both better flushing and increased volume in the production area.

Three methods are particularly used:

- A polymer is injected at a concentration of 500 to 3,000 ppm (typically 1,000 to 1,500 ppm) with viscosities varying with water salinity from 5 to 100 cps.
- A polymer and a surfactant are injected (SP), the polymer being at the same concentrations as above, where the surfactant improves the oil in place mobilization.
- A polymer, a surfactant and an alkaline product are injected (ASP). The surfactant and the alkali disperse the oil into the water injected, delivering better extraction. The polymer is injected at higher concentrations (2,000-3,000 ppm) but its viscosity is reduced by the presence of alkalis at similar values (5 to 100 cpm).

High-molecular weight water-soluble polymers are subject to mechanical degradation. It breaks the chains and reduces the viscosity of the solution injected. This reduction in viscosity can occur in any system containing shear: pumps (especially centrifuge pumps), piping, and injectors, but especially in chokes.

It is therefore necessary to find a solution that reduces shear and improves polymer efficacy.

In small oil wells, one of the solutions is to use a length of tube with smaller diameter than the pumping piping that increases the rate of passage and therefore progressively reduces pressure. Potential rates up to 10 meters per second have little effect on the mechanical degradation but long lengths of piping are needed to obtain limited pressure drop: from 50 to 200 meters on installations existing for 10 bars of pressure drop. What is more, it is necessary to change the length of piping during the life of the field to progressively adapt the injection pressure to the pressure of the field without creating fracturing.

No method exists, to date, for reducing pressure by between 0 and 50 bars without shear.

BRIEF SUMMARY OF THE INVENTION

The solution proposed is to replace the choke by a volumetric pump whose flow rate is controlled. This volumetric pump works like a motor and the rate reduction reduces the flow rate and therefore injection pressure. To do this a brake system has to be used to control the rate of the volumetric pump.

More precisely, an aspect of the invention is a process for reducing the injection pressure of a solution of water-soluble polymer from a given injection pump in various oil wells in a given field as a function of the fracturing pressure for each well according to which between the injection pump and each of the wells, a main volumetric pump, advantageously reversible, is placed whose rate is controlled using a brake.

According to one essential feature of the invention, the industrial pump used as a motor is of the volumetric type and reversible i.e. it can function equally as a pump and as a motor, which limits its industrial selection to gear or lobe pumps.

In practice, gear pumps, such as made for example by Witte Pumps and Technology Gmbh or Coreau SA, have standard flow rates ranging up to 200 $m^3/h$ for core pressures of 300 bars and differential pressures of 200 bars.

These pumps are made of various materials that can resist brine injected into oil wells that has quantities of dissolved solids ranging up to 200,000 ppm. The preferred pumps are manufactured out of duplex or super duplex [stainless steel] and in extreme applications out of ceramic.

These pumps are reversible and therefore for a specific well this would be receiving a polymer solution at high pressure, for example 120 bars, to reduce it by 0 to 50 bars so as to inject it into the well at a pressure of 70 to 120 bars.

This pressure varies widely from one field to another, for example 40 to 250 bars, but in a given field and for a given injection pump, the differential injection pressure between various wells is usually below 30 bars, exceptionally below 50 bars.

The flow rate per well obviously depends on the type and size of the well. In particular, much smaller quantities of polymers are injected into vertical wells than into horizontal wells.

On average, 10 to 40 $m^3/h$ of polymer solution is injected into a vertical well, and 50 to 300 $m^3/h$ polymer into a horizontal well.

The gear pump will be selected as a function of:

- The maximum planned injection flow rate.
- The upstream pressure, which is the maximum pressure of the injection pumps.
- The pressure differential between the wells fed by this pump.
- The composition of the brine that will determine the material to use for the body, rotors, bearings, joints, packers.
- The longevity of the pump that will determine its rotation rate, in particular, the rotation rates will be limited to reduce the upkeep to a minimum in offshore applications.

The pump used as motor will have to have a brake so as to reduce the flow rate and therefore the injection pressure.

The type of brake used must be mechanical or electrical, removing friction systems that have limited longevity.

How this brake is selected will depend on conditions of use and the options for dissipation of the heat generated.

In a first embodiment, the well is an offshore well and the brake is in the form of a volumetric pump fed by sea water and connected to the motor shaft of the main volumetric pump, the flow rate of the volumetric pump serving as brake being regulated by a valve located downstream of said pump whose closing and opening is managed as a function of the injection pressure determined for each well.

More specifically, in offshore conditions the quantities of cooling water are unlimited. In this case, a volumetric pump will be selected as brake. The motor shaft of the main pump will be connected to another volumetric pump serving as brake, for example a gear pump, whose flow rate will be regulated by a discharge valve. To limit the size, this pump will be a high pressure pump, for example 200 bars, and its pumping volume to create a maximum pressure drop of 50 bars will be lower than the main flow rate under these conditions. This pump will be fed by seawater via a filter, for example a 20 micron filter, or two filters in parallel cleaned successively with countercurrent filtered water.

The whole will be regulated by measuring the pressure at injection acting directly on the valve closure of the brake pump.

Obviously, other types of volumetric pumps can be used as brake and in particular irreversible pumps: piston pumps, high-pressure Moineau type pumps, etc.

In a second embodiment, the well is a land well and the brake is an electric brake.

More specifically, in land conditions, in most cases, local conditions do not deliver access to sufficient quantities of water to use one brake per pump. In this case, an electric brake of Telma® type is used, for example, i.e. an Eddy current braking system with integrating cooling with internal ventilation.

This system is widely used for truck braking

The main pump will be selected in these cases at a higher rate to remain within the range of efficacy of the Telma® brake to 300-500 rpm. It is also possible to multiply the rate by gears to work at higher rates, i.e. up to 3000 rpm. The brake is selected from among the sizes in the Valeo® range, for example.

According to the invention, the polymer injection pressure ranges from 50 to 300 bars and the fracturing pressure in the wells from 0 to 100 bars lower, preferably from 0 to 50 bars.

BRIEF DESCRIPTION OF THE DRAWING FIGURES

The invention and the benefits that flow from it will be clear from the following examples of embodiments, using the appended figures.

FIG. 1 shows the drop in viscosity, which can be very large, regardless of the concentration of polymer injected.

DETAILED DESCRIPTION

Figure 1:
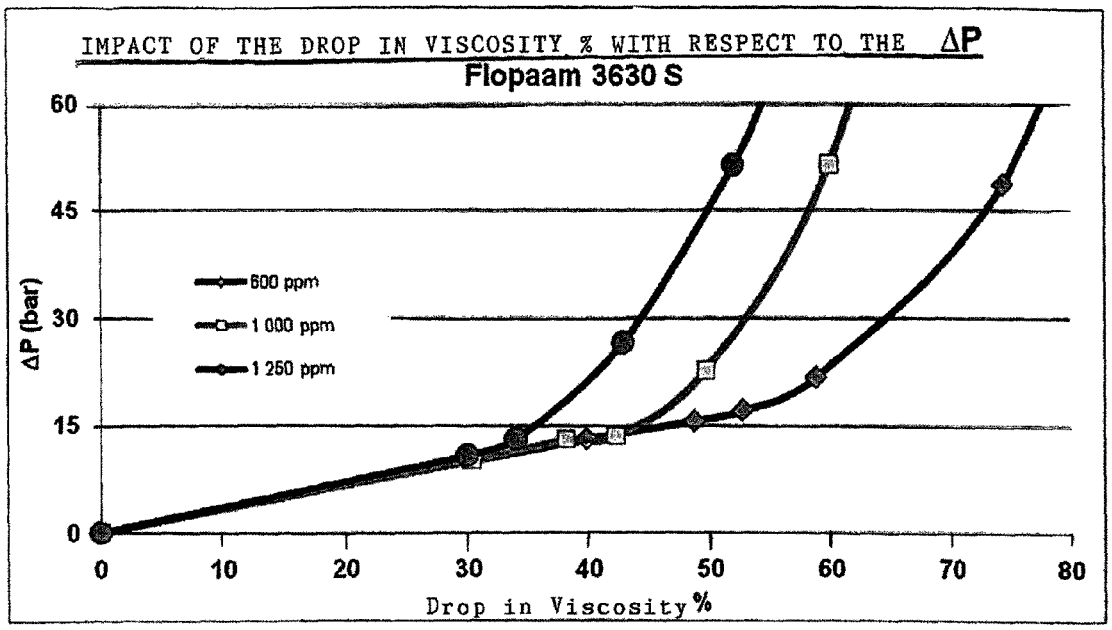
FIG. 1 is a plot showing the impact of the loss of viscosity in a polymer solution as a function of shear in a Cameron® choke with flow rate 100 $m^3/h$.
Figure 2:
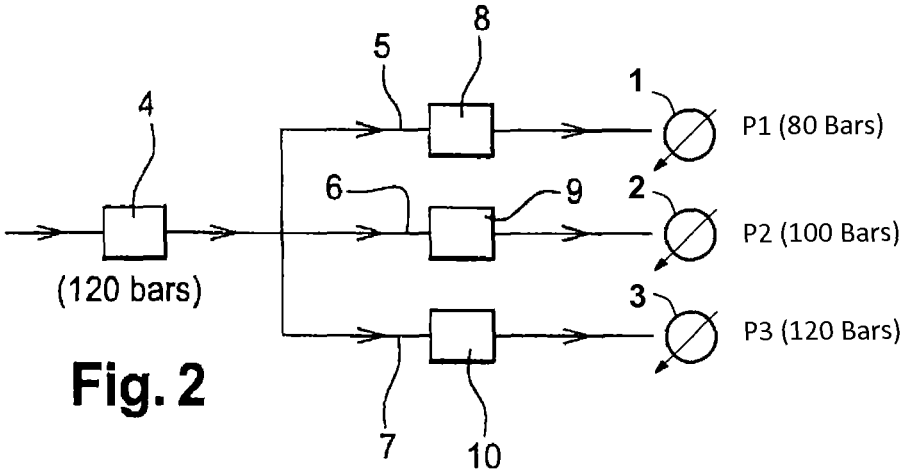
FIG. 2 is a schematic representation of the principle of an installation using the process of the invention.

In FIG. 2, the general principle of the installation using the process is shown. In the main, the polymer solution is injected into the various wells 1, 2 and 3 (P1, P2, P3) from a single injection pump (4) through distinct pipes (5, 6, 7). The chokes presented conventionally on these pipes are replaced according to the invention by volumetric pumps (8, 9, 10) whose rate is controlled by a brake, not shown. This system controls the injection pressure of the polymer solution from the pump (4) at a pressure, for example, of 120 bars, as a function of the fracturing pressure for each of the wells, for example from 80 to 120 bars.

Figure 3:
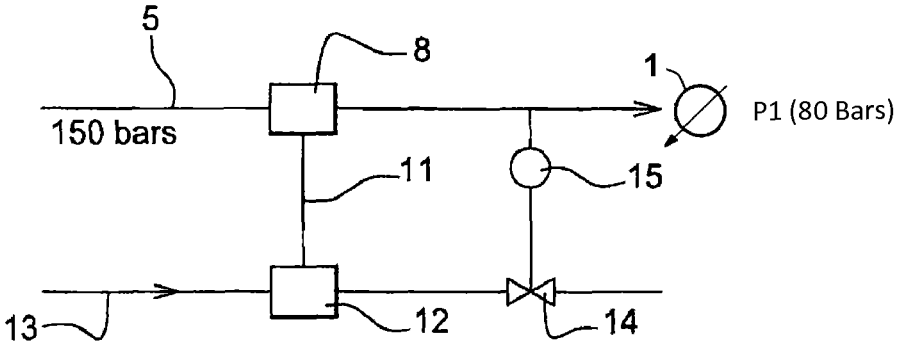
FIG. 3 is a schematic representation of an installation using the process of the invention according to a first embodiment.

In FIG. 3, a first embodiment of the installation is shown schematically, which is reproduced on each pipe (5, 6, 7). This type of installation is more particularly used for offshore oil extraction. In this embodiment, the main volumetric pump (8) is connected (11) by its motor shaft to a second volumetric pump (12) fed by a pipe (13) in which sea water circulates. Downstream of the pump (12) a discharge valve (14) is located, controlled by a manometer (15) detecting the fracturing pressure of the well in which the polymer solution must be injected. As a function of the fracturing pressure detected, the discharge valve (14) is closed to varying degrees, which slows the flow rate of the main pump (8) by braking its motor shaft through the pump (12).

Figure 4:
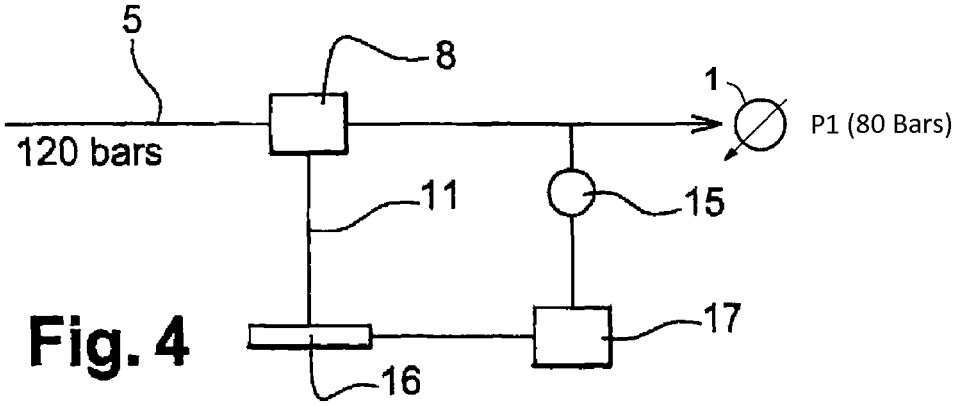
FIG. 4 is a schematic representation of an installation using the process of the invention according to a second embodiment.

The configuration illustrated in FIG. 4 corresponds to a land installation. In this case, the main pump (8) is no longer braked mechanically by a second volumetric pump but using a brake (16) for example of the Telma® type powered by a battery (17). Braking remains a function of the fracturing pressure detected in the well using a manometer (15).

Example 1

A land field has the following characteristics:

Number of injection wells: 12

Types of well: vertical

Brine injected: 12,000 ppm of dissolved solids $H_2S$: 15 ppm

Temperature: 55° C.

Maximum planned flow rate per well: 32 $m^3/h$

Injection pump pressure 110 bars

Injection pressure for the lowest pressure well: 80 bars

Polymer concentration: 900 ppm (Polyacrylamide type 3230S at 30% anionicity and molecular weight 20 moles)

Pumping viscosity: 12.6 cps.

In this case, the pressure will be reduced using gear pumps:

Core pressure: 150 bars

Construction: Duplex

Maximum flow rate: 35 $m^3/h$

Pump displacement: 2 liters

Maximum speed: 500 rpm

The pump shaft is mounted on a Telma® brake, that can vary from 500 to 300 rpm, i.e. from 36 to 21 $m^3/h$.

Taking a sample of a polymer solution with a pressure drop of 40 bars will give the following results:

Viscosity before the pump: 12.6 cps (Brookfield Grpm)

Viscosity after the pump: 11.4 cps

In the case of using a choke with 40 bar pressure drop, the viscosity would be of the order of 5 cps, highly reducing the enhanced recovery effect.

Example 2

In an offshore application, the field has the following characteristics:

Number of injection wells: 4
Type of well: horizontal
Brine injected: 50,000 ppm dissolved solids
$H_2S$: 40 ppm
Temperature of water injected from the sea bed: 45° C.
Maximum flow rate per well: 100 $m^3/h$
Maximum injection pressure in the choke: 120 bars
Minimum injection pressure: 90 bars for the well with lowest pressure.

In this case, the gear pump used as motor will have the following characteristics:

Core pressure: 200 bars
Construction: Duplex
Maximum flow rate: 110 $m^3/h$
Pump displacement: 5.5 liters
Maximum pump rate: 300 rpm The pump shaft is joined to another gear pump having the following characteristics:

Calculated pressure: 200 bars
Flow rate: 60 $m^3/h$
Displacement: 2 liters
Construction super duplex
Maximum rotation rate: 500 rpm A discharge valve after the second pump is controlled by the injection pressure on the well and reduces the flow rate so as to brake the main pump from 300 to 200 rpm, reducing the flow rate from 100 to 66 $m^3/h$ on the well with lowest fracturing pressure.

The pump is powered through two countercurrent declogging filters and uses the pressure of the brake pump to clean these filters one after the other.

The principle for this process can receive diverse variants, and in particular use the power of the main pump to recover electricity via an alternator or a dynamo. It is also possible to use an air compressor as a brake and to regulate the pressure through the air flow engendered.

The skilled person will be able to adapt all the technical methods necessary to do this.

The invention claimed is:

1. A process for reducing pressure for injecting a solution of water-soluble polymer from a single injection pump into various oil wells in a given field as a function of fracturing pressure for each well, comprising: employing the single injection pump to provide the same solution of water-soluble polymer with a first well injection pressure concurrently to the various oil wells, placing a respective main volumetric pump between the single injection pump and each respective well, detecting fracturing pressure of each respective well with a pressure measuring instrument, and controlling flow rate of the respective main volumetric pump, using a brake, to reduce the first well injection pressure of the solution from the single injection pump to a second well injection pressure below the detected fracturing pressure of the respective well, wherein the second well injection pressure is equal to or lower than the first well injection pressure.

2. The process according to claim 1, wherein the main volumetric pump is reversible.

3. The process according to claim 1, wherein the main volumetric pump comprises a gear pump.

4. The process according to claim 1, wherein each well is an offshore well and the brake comprises a second volumetric pump fed with sea water and connected to a motor shaft of the main volumetric pump, and said controlling comprises: regulating flow rate of the second volumetric pump by a valve located downstream of said second volumetric pump, and managing valve closing and opening as a function of the detected fracturing pressure of each well.

5. The process according to claim 4, wherein the second volumetric pump comprises a reversible volumetric gear pump.

6. The process according to claim 4, wherein the second volumetric pump comprises an irreversible piston pump.

7. The process according to claim 4, wherein the second volumetric pump is fed by seawater via at least one filter, and the at least one filter is cleaned with countercurrent filtered water under pressure from the second volumetric pump.

8. The process according to claim 1, wherein the well is a land well and the brake comprises an electric brake.

9. The process according to claim 8, wherein the electric brake comprises an Eddy current braking system integrating cooling by internal ventilation.

10. The process according to claim 1, wherein the first well injection pressure is from 50 to 300 bars and the fracturing pressure of the well is from 0 to 100 bars lower.

11. The process according to claim 1, wherein the fracturing pressure of each well is detected by employing a respective manometer.

* * * * *